US005191971A

United States Patent [19]

Hakkarainen et al.

[11] Patent Number: 5,191,971

[45] Date of Patent: Mar. 9, 1993

[54] MULTI-POSITION WALL MOUNTABLE CONTROL SWITCH WITH TACTILE FEEDBACK LINEAR ACTUATOR

[75] Inventors: Susan S. Hakkarainen, Bethlehem; Robert S. Hanna, Coopersburg; Elliot G. Jacoby, Glenside; Robert F. Taylor, III, Bethlehem, all of Pa.

[73] Assignee: Lutron Electronics Co., Inc., Coopersburg, Pa.

[21] Appl. No.: 680,990

[22] Filed: Apr. 5, 1991

[51] Int. Cl.[5] ..... H01H 15/06

[52] U.S. Cl. ..... 200/550; 200/547; 200/548; 200/257; 200/292; 200/16 D

[58] Field of Search ..... 200/547, 548, 549, 550, 200/551, 252, 257, 258, 259, 260, 261, 277, 277.1, 291, 292, 16 A, 16 C, 16 D, 297

[56] References Cited

U.S. PATENT DOCUMENTS

| | | | |
|---|---|---|---|
| 2,246,373 | 6/1941 | Lodge | 200/16 C |
| 2,725,437 | 11/1955 | Brown | 200/550 X |
| 3,384,850 | 5/1968 | Cameron et al. | 200/277 X |
| 3,670,117 | 6/1972 | Yancey | 200/16 C |
| 3,739,126 | 6/1973 | Sahrbacker et al. | 200/548 |
| 3,971,905 | 7/1976 | Delaage | 200/277 X |
| 4,152,565 | 5/1979 | Rose | 200/548 |
| 4,352,993 | 10/1982 | Hannas | 307/112 |
| 4,354,069 | 10/1982 | Ragen | 200/277 X |
| 4,408,150 | 10/1983 | Holston et al. | 318/779 |
| 4,441,000 | 4/1984 | Suwa | 200/548 |
| 4,924,349 | 5/1990 | Buehler et al. | 200/297 X |
| 5,051,549 | 9/1991 | Takano | 200/160 X |

FOREIGN PATENT DOCUMENTS 1100755 3/1961 Fed. Rep. of Germany ..... 200/297

OTHER PUBLICATIONS

Emerick, IBM Technical Disclosure Bulletin, Nov. 1969, vol. 12, No. 6.

*Primary Examiner*—Henry J. Recla
*Assistant Examiner*—Glenn T. Barrett
*Attorney, Agent, or Firm*—Woodcock Washburn Kurtz Mackiewicz & Norris

[57] ABSTRACT

A multiple position wall mountable linear slide switch has a wheel disposed between a linearly moveable actuator and a stationary bearing surface for rolling the actuator in a linear path over the bearing surface upon application of an external sliding force to the actuator. The wheel carries a conductive axle for establishing an electrical connection between switch contacts defining each switch setting. The bearing surface has a plurality of detents, one associated with each switch setting, so that, as the actuator is moved from one position to another, the wheel rolls out of one detent then into another. This motion of the wheel automatically raises the axle away from the contacts at one setting then lowers the axle onto the contacts at an immediately subsequent setting as the actuator is moved between corresponding positions. Additionally, a spring is disposed between the actuator and the wheel/axle combination to urge the wheel against the bearing surface to provide a tactile feedback to the user as the actuator is moved into and out of each setting and to urge the axle against the contacts at each setting.

76 Claims, 6 Drawing Sheets

FIG. 1
PRIOR ART
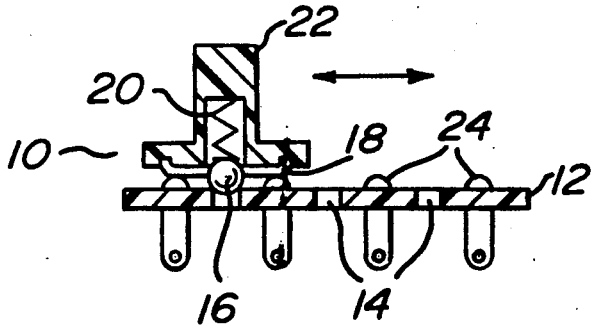
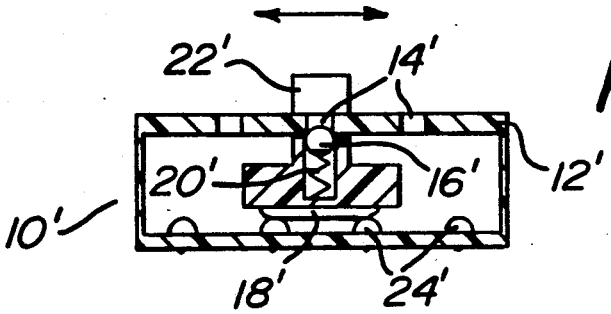
FIG. 2
PRIOR ART
FIG. 11
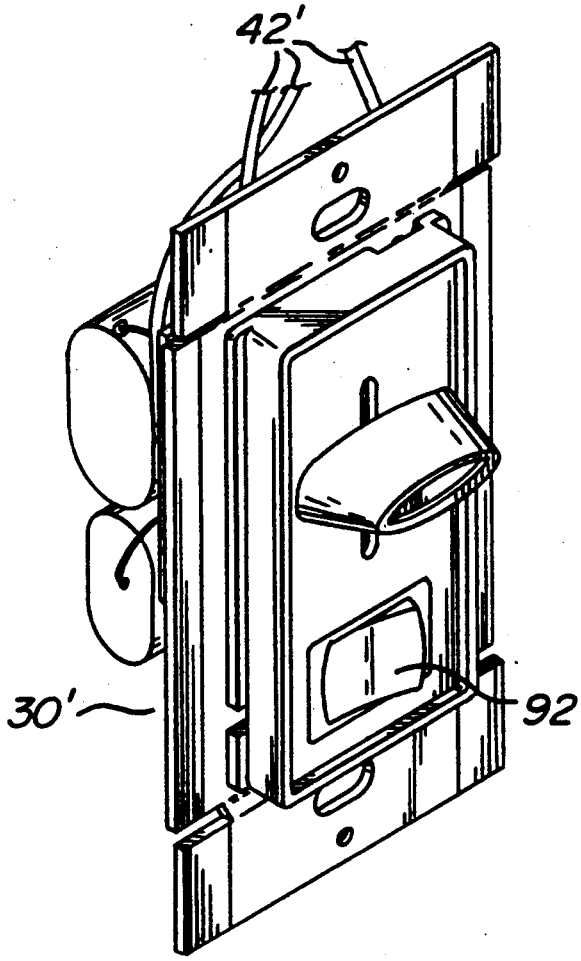

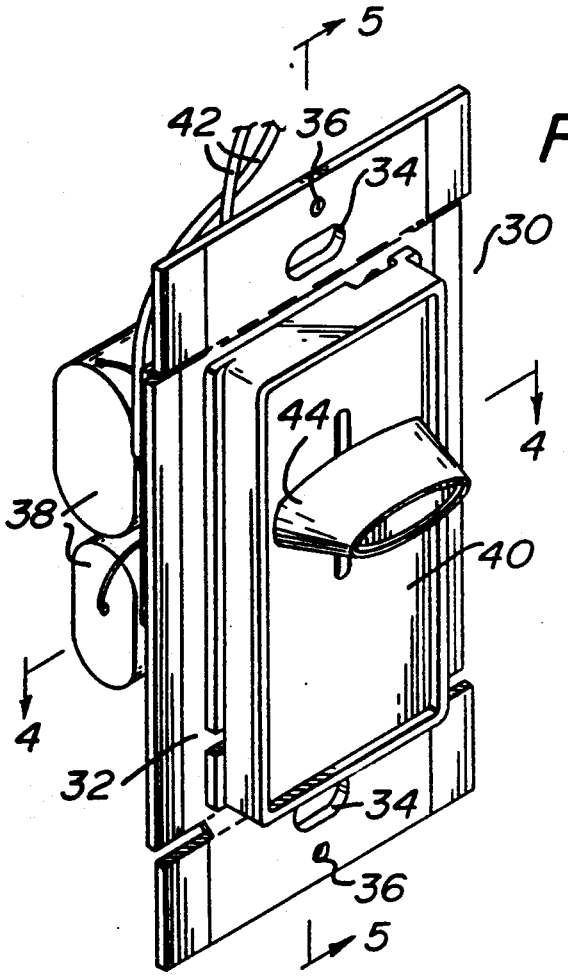
FIG. 3
FIG. 8
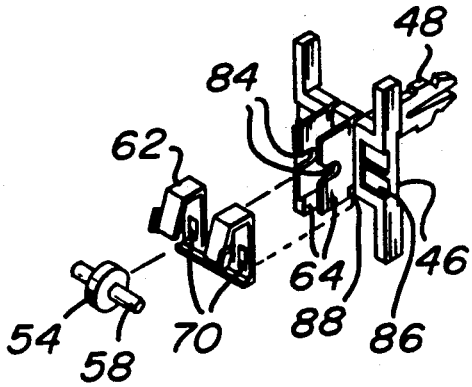
FIG. 4
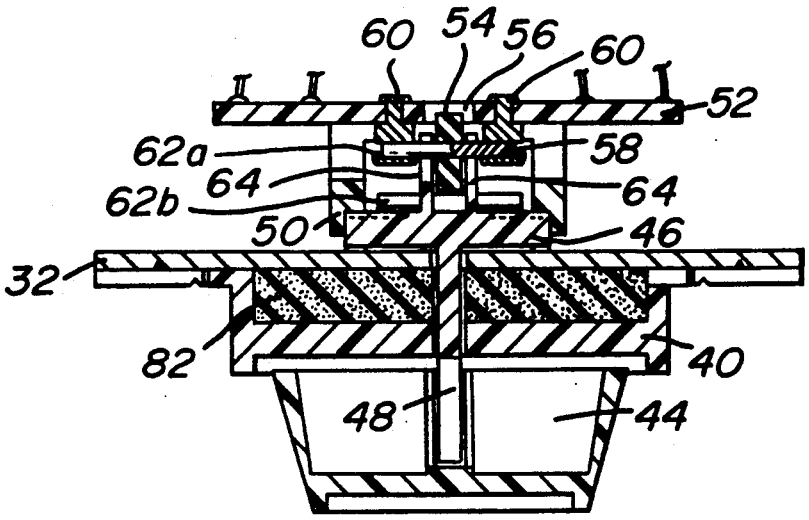

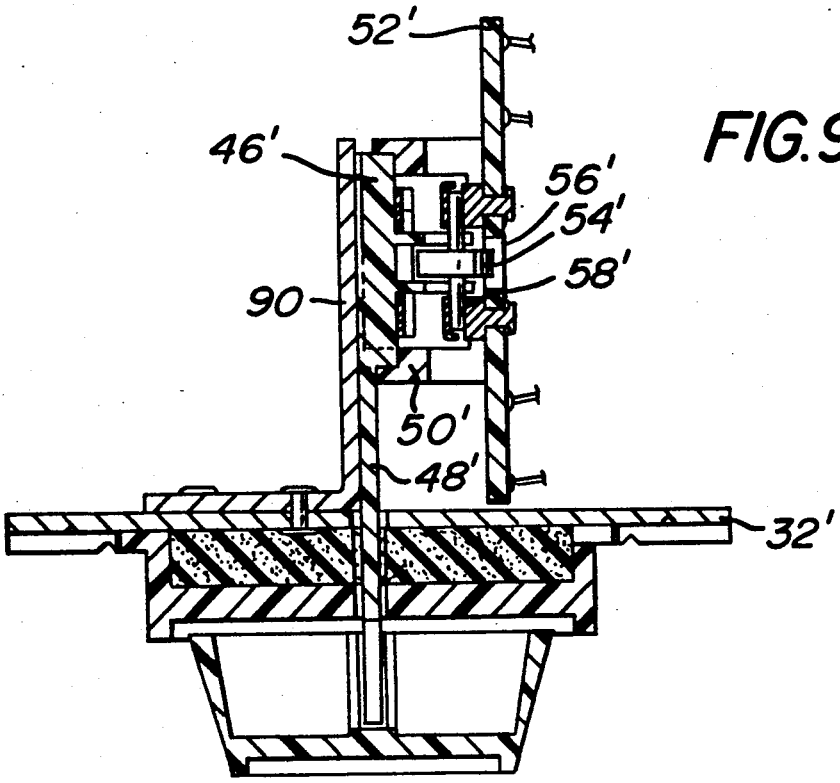
FIG. 9
FIG. 10
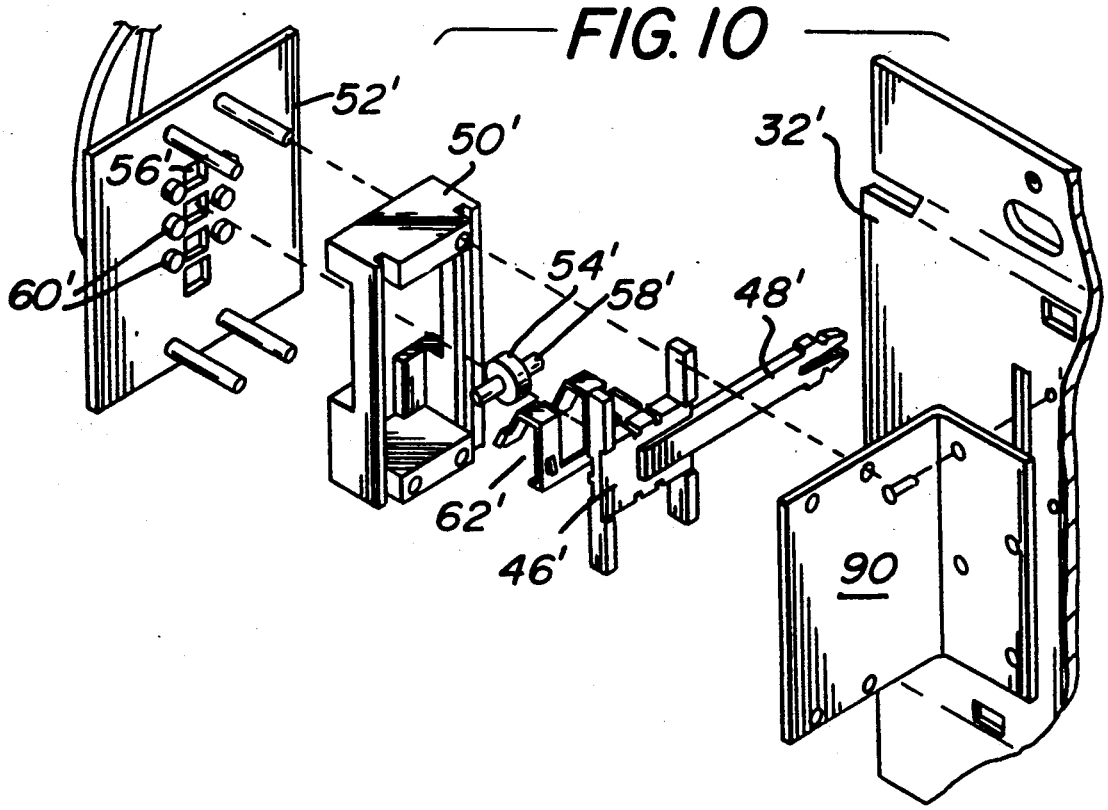

MULTI-POSITION WALL MOUNTABLE CONTROL SWITCH WITH TACTILE FEEDBACK LINEAR ACTUATOR

FIELD OF THE INVENTION

The present invention relates generally to wall switches. More particularly, the present invention relates to a multiple position wall switch having a linear actuator with tactile feedback for adjusting the setting thereof.

BACKGROUND OF THE INVENTION

Multiple position wall switches for controlling a load, such as fan speed, are known in the art. Typically, the switch includes control circuitry responsive to each setting thereof to control the power delivered to the load. For example, U.S. Pat. No. 4,408,150 discloses a so-called "quiet" fan speed control that provides several selectable impedances, typically capacitors in series with the motor armature of the fan, to provide various reduced levels of power to the motor from an AC source. The power reduction is proportional to the series impedance. Switches of this type are said to be "quiet" since they do not use semiconductor switching techniques, and therefore do not produce audible high frequency noise. Another example is the De-Hummer Fan Speed Control manufactured by Power Controls of San Antonio, Tex. This device is wall mountable and is operated by a rotatable switch and actuator. The switch can be positioned to select among four capacitance values, thus providing four discrete speed settings and an off setting.

A drawback of rotatable switches is that they do not provide a quickly discernable indication of their setting, since the rotation has no inherent starting or ending point. Linearly actuable switches overcome this drawback, since the speed setting can be visually determined by the position of the slider or actuator.

Conventional linearly actuated switches are designed to be operated by one or two fingers moving relative to a hand that is fixed within a local frame of reference. They are not well-adapted for wall mounted use, where the entire arm may be used to actuate the switch. Specifically, the force required to move the switch from one position to the next typically results in overshoot, due to the feedback control characteristics of the human arm/muscle system, which quickly pushes the actuator past the desired position. This makes wall mounted linear switches of this type difficult to use.

The Sunrise Whispurr fan speed control manufactured by Lightolier Controls, Secaucus, N.J., includes a four position linear slide switch for selecting among three speed settings, and an off setting. The actuator requires application of a relatively large force (between about 1.5 and 2 lbs.) to move it from one position to the next. In addition, the actuator can be inadvertantly set between adjacent positions so that the switch becomes inoperative and power is removed from the fan motor.

Co-pending, commonly assigned U.S. patent application Ser. No. 478,604 filed Feb. 12, 1990 discloses a quiet fan speed control with a linear adjustment actuator. The switch disclosed in that application employs a slidable actuator having a pair of cantilevered members that cooperate with a cam surface having sloped walls that define a series of detention steps. As the actuator is moved from one position to another, the cantilevered members flex inwardly and outwardly, and at each detention step, engage a notch so as to provide tactile feedback to a user that the actuator has been moved from a position corresponding to one setting to another. As a result of the structure of the switch disclosed therein, the "force profile", i.e., the amount of force required to displace the actuator from one position to another, is both linear and abrupt.

FIGS. 1 and 2 hereto illustrate mechanisms 10, 10' which have been used in prior art multiple position linear slide switches. As shown in FIG. 1, the mechanism 10 comprises a board 12, such as a circuit board, having an actuator 22 disposed thereover. The board 12 has a plurality of pairs of contacts 24 disposed thereon, each defining a different setting of the switch. Disposed on the underside of the actuator 22 is a conductor 18 biased against the contacts 24 by springs (not shown). A ball 16 cooperates with one of a plurality of detents 14 disposed between each pair of contacts 24. When the actuator 22 of switch 10 has been moved to a position corresponding to one of the settings, a spring 20 urges the ball 16 into a corresponding one of the detents 14, and the conductor 18 provides an electrical connection between a pair of the contacts 24. The mechanism 10' illustrated in FIG. 2 operates in substantially the same manner, except that the spring 20' urges the ball 16' into one of a plurality of detents 14' located on the other side of the actuator.

A drawback of both mechanisms is that the conductor 18 (18') which travels with the actuator 22 (22') drags on the contacts 24 (24') as the actuator 22 (22') is moved from one position to another. Another drawback is that the construction of mechanisms of this type can make their assembly time-consuming and/or difficult since the ball 16 must be maintained in alignment with the spring 20 as it is compressed, and there is nothing to keep the ball 16 from becoming dislodged until it has been captured between the actuator 22 and the board 12.

U.S. Pat. No. 4,152,565 discloses a BCD slide switch that employs a pair of balls compressed between curved cam surfaces and into the sides of an actuator (rather than underneath or on top of the actuator, as in FIGS. 1 and 2 above). As in the case of FIGS. 1 and 2 above, a conductor is employed to establish electrical connection between contacts as the actuator is moved from one position to another. This switch, however, suffers from the same drawbacks as those described in connection with U.S. application Ser. No. 478,604 and FIGS. 1 and 2 described above. That is, the conductor drags on the contacts as the actuator is moved from position to another, and assembly of the switch may be difficult and/or time consuming since the balls 32 must be compressed into the actuator 6 while locating it between the cam surfaces to prevent them from becoming dislodged during assembly. Moreover, the switch of U.S. Pat. No. '565 is not suitable for wall mounting, nor is the structure disclosed therein suitable for carrying the high load currents frequently carried by wall mounted switches.

It is therefore desirable to provide a wall mountable, multiple position control switch with a linear adjustment actuator that has smooth positive operation between positions without overshoot while providing tactile feedback to the user. It is further desirable that such switch be simple in construction and therefore easy to assemble. The switch of the present invention achieves these goals.

SUMMARY OF THE INVENTION

According to one embodiment of the invention, a multiple position linear slide switch comprises a plurality of electrical contacts defining a plurality of different switch settings. An actuator is movable in a linear path between positions corresponding to each switch setting, and a roller means is disposed between the actuator and a stationary bearing surface for rolling the actuator in the linear path over the bearing surface upon application of an external sliding force to the actuator. The roller means includes an integral conductor for establishing an electrical connection between the contacts at each setting.

According to another embodiment of the invention, a multiple position linear slide switch comprises a plurality of electrical contacts defining a plurality of different switch settings. An actuator is movable in a linear path between positions corresponding to each switch setting and has associated therewith a conductor movable with the actuator for establishing an electrical connection between the contacts at each setting. There is also provided means cooperating with the conductor for automatically raising the conductor away from the contacts at one setting then lowering the conductor onto the contacts at an immediately subsequent setting as the actuator is moved between the corresponding positions so that the conductor is prevented from dragging appreciably on the contacts.

According to yet another embodiment of the invention, a multiple position linear slide switch comprises a bearing surface having disposed thereon a plurality of electrical contacts defining a plurality of different switch settings. The bearing surface has a detent adjacent the contacts of each switch setting. An actuator is movable in a linear path between positions corresponding to each switch setting. A spring loaded roller means is coupled to the actuator for rolling on the bearing surface in response to application of an external sliding force to the actuator. The roller means is urged against the bearing surface by a spring force provided by the spring loading, and the roller means is rolled into and urged against one of the detents by the spring force when the actuator has been moved to a position corresponding to one of the switch settings. The roller means includes an integral conductor for establishing an electrical connection between contacts at each setting when the roller has been rolled into and urged against a corresponding detent so that the rolling and urging of the roller means into a detent provides a positive tactile feedback to a user moving the actuator that an electrical connection has been established.

According to a preferred embodiment of the invention, the bearing surface is a circuit board having a control circuit and the electrical contacts disposed thereon. Further, according to a preferred embodiment, the roller means comprises a resilient wheel and the conductor is an axle extending through the wheel and being arranged to establish the electrical connection between the contacts at each setting.

According to a most preferred embodiment of the invention, application of an external sliding force sufficient to overcome the spring force is required to be applied to the actuator by the user to roll the roller means out of a detent once an electrical connection has been established. The overcoming of the spring force and the rolling of the roller means out of the detent is transmitted through the actuator and provides a positive tactile feedback to the user that the electrical connection has been broken. The external sliding force required to be applied to move the actuator from a first position corresponding to one setting to a second position corresponding to another immediately preceding or succeeding setting increases from the first position to a location in between the first and second positions. Then, the external sliding force required to be applied decreases from the location in between the first and second positions to the second position. When the actuator has been moved to the proximity of a position corresponding to one of the settings, the spring loading rapidly urges the roller means into an associated detent to provide a first snap action tactile feedback to the user. Additionally, when the actuator is moved out of a position corresponding to a setting, the action of the roller means rolling out of a associated detent is resisted by but rapidly overcomes the spring loading to provide a second snap action tactile feedback to the user that the electrical connection has been broken.

Other feature and advantages of the multiple position linear slide switch of the present invention will be appreciated from the following specification and claims.

BRIEF DESCRIPTION OF THE DRAWINGS

FIGS. 1 and 2 illustrate relevant details of two prior art slide switch mechanisms.

FIG. 3 is a perspective view of one embodiment of a multiple position wall mountable control switch with linear adjustment actuator according to the present invention.

FIG. 4 is a cross section taken along line 4—4 of FIG. 3.

FIG. 8 is a partial exploded view of the switch of FIG. 3 and illustrates the cooperation between the actuator, spring and roller means of the present invention.

FIG. 9 is a cross sectional view illustrating another embodiment of a multiple position wall mountable control switch with linear adjustment actuator according to the present invention.

FIG. 10 is an detailed exploded view of the switch of FIG. 9.

FIG. 11 is a perspective view of yet another embodiment of a multiple position wall mountable control switch with linear adjustment actuator according to the present invention.

DETAILED DESCRIPTION OF THE DRAWINGS

Figure 5:
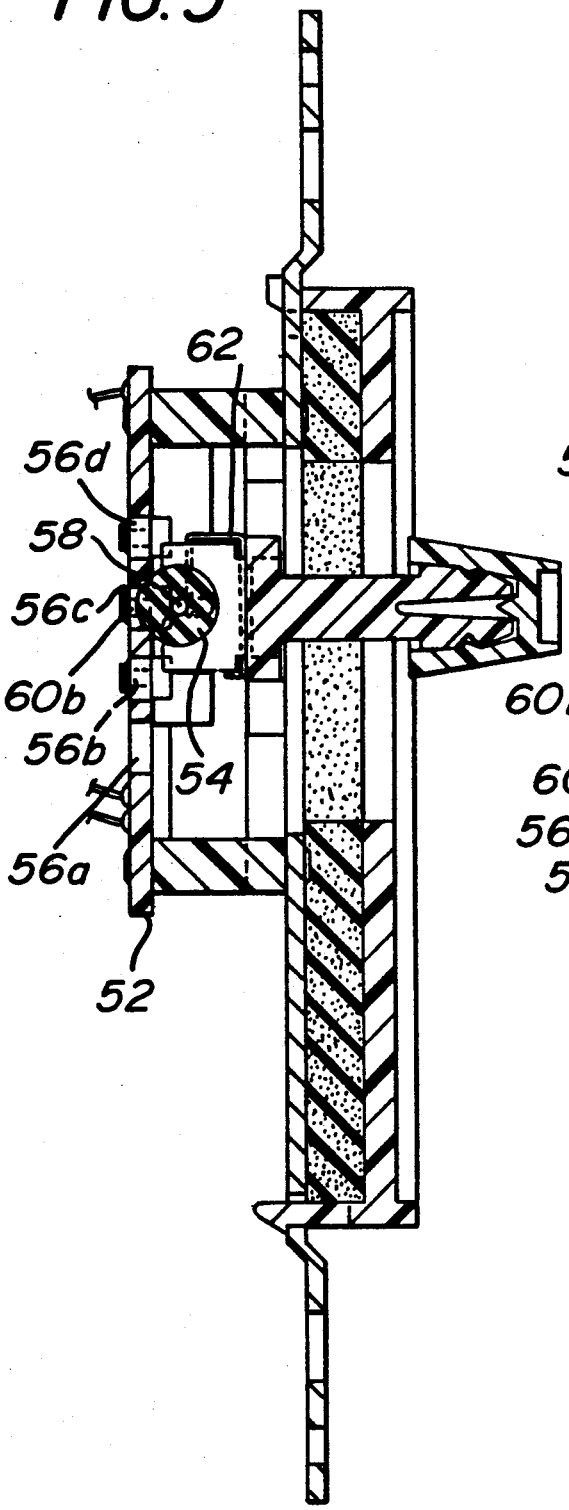
FIG. 5 is a cross section taken along line 5—5 of FIG. 3 and illustrates the actuator as having been moved to a position corresponding to one of the switch settings.

Turning now to the drawings, wherein like numerals represent like elements, there is illustrated in FIG. 3 a multiple position wall mountable control switch with linear adjustment actuator according to one embodiment of the present invention and labelled generally 30.

The switch 30 of FIG. 3 is illustrated as being provided with an optional cover 40 of a type that cooperates with a well-known decorator style wall plate (not shown), but the present invention is not limited thereto. Rather, the present invention has applicability to any style wall mounted switch, for example, but not limited to, a switch that cooperates with a standard toggle switch wall plate. As illustrated, the switch 30 of FIG. 3 comprises a support plate 32 having elongated holes 34 for mounting to a NEMA (National Electrical Manufacturers Association) standard wall box having a width of about 1 31/32" and a length of about 3 9/32". The support plate 32 preferably has overall dimensions sufficient to overlap the length and width of the wall box. Also provided are holes 36 for mounting the wall plate (not shown) to the support plate 32.

The support plate 32, also referred to herein, and in the appended claims, as a yoke has inner and outer surfaces, and has disposed adjacent the inner surface thereof control circuitry 38 for controlling the power delivered to a load, for example, for controlling fan speed. Conductors 42 are operatively coupled to the control circuitry 38 for connection to the load.

As shown the switch 30 is also provided with a knob 44 that cooperates with a stalk 48 (see FIG. 4) coupled to an internal actuator 4 for adjusting the switch setting.

Turning now to FIG. 4, there is shown a cross section of the switch of FIG. 3 taken along line 4—4. As shown, the knob 44 cooperates with the stalk 48 of an actuator 46 that is slidably sandwiched between the support plate 32 and a circuit board 52. The circuit board 52 performs two functions. It contains the control circuitry 38 and switch contacts 60 and also acts as a bearing surface in a manner to be described hereinafter. A pair of contacts 60 defines each switch setting (see FIG. 7), with a substantially square hole 56 disposed between each pair of contacts 60. As will be appreciated hereinafter, each square hole 56 defines a detent.

Figure 7:
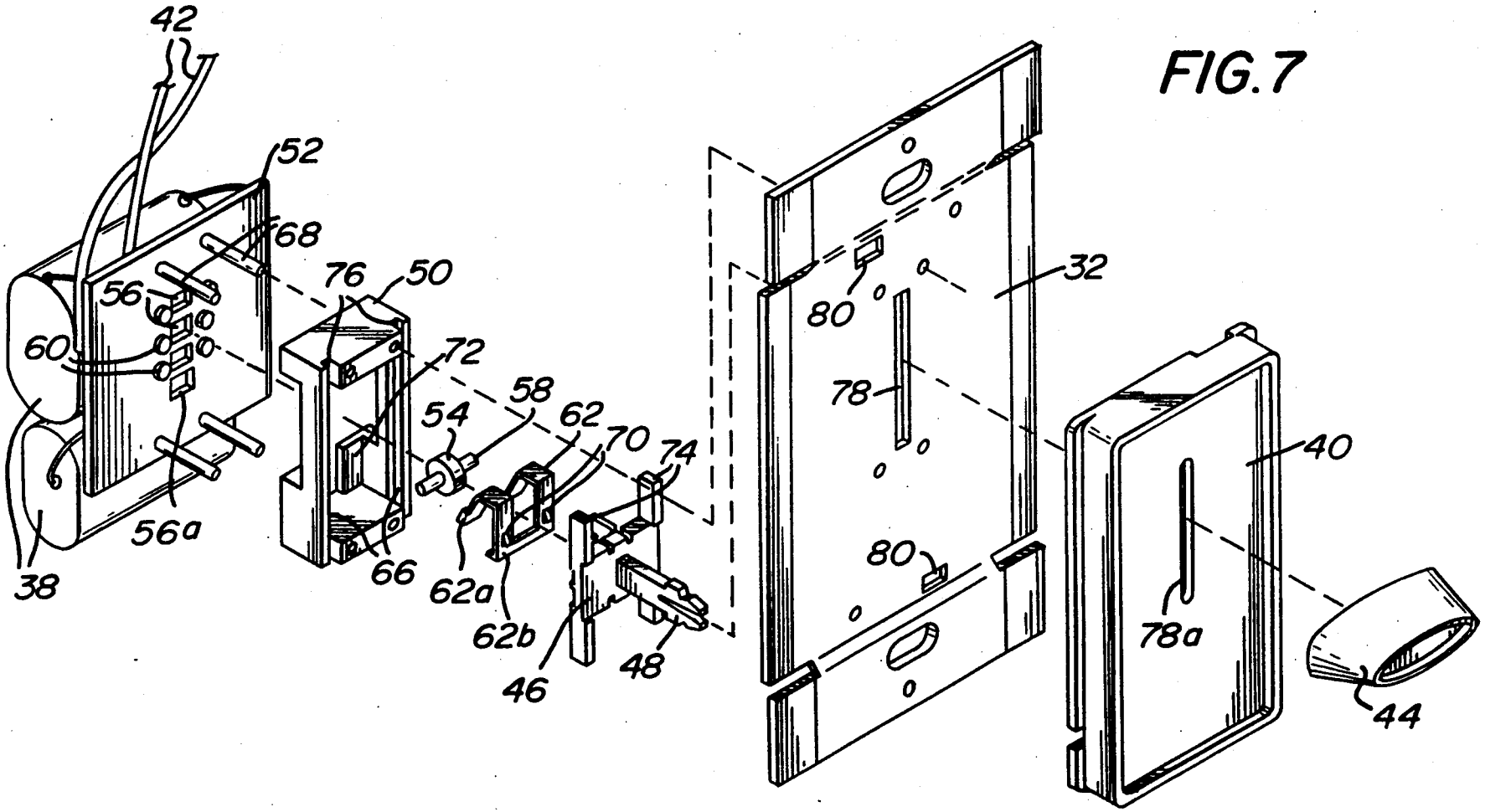
FIG. 7 is an detailed exploded view of the switch of FIG. 3.

In the embodiment illustrated in FIG. 4, the circuit board 52 is substantially parallel to the support plate 32. As shown therein, a non-conductive cradle 50 is mounted to the circuit board, and, as shown in FIG. 7, to the support plate 32 by means of eyelets 68. The actuator 46 is slidably guided in a pair of guide rails 66 (see FIG. 7) formed in the cradle 50. The actuator 46 also has a pair of upstanding members 64, best illustrated in FIG. 8, for carrying a wheel 54 and an electrically conductive axle 58, collectively defining a roller means. As best illustrated in FIG. 8, the upstanding members 64 have a notch 84 therein for receiving the axle 58. A substantially U-shaped spring 62 is disposed between the axial 58 and the actuator 46 and has a pair of legs 62(*a*), 62(*b*). As best shown in FIG. 4, the pair of legs 62(*a*) urge against the axle 58, while the pair of legs 62(*b*) urge against a substantially flat surface on the underside of the actuator 46. As will become appreciated hereinafter, this construction causes the wheel 54 to be urged against the circuit board 52 so that, when the switch is in one of the settings, the wheel 54 is urged into a detent 56 associated with that setting and the axle 58 establishes an electrical connection between the contacts at that setting.

Turning now to FIG. 8, additional details of the switch of FIG. 3 will be explained. As shown, the stalk 48 is integral with actuator 46 (see also FIG. 7), and the upstanding members 64 have slots 88 disposed on either side thereof for receiving a side of spring 62 having its legs 62(*b*) joined together. See also FIG. 7. The legs 62(*b*) of spring 62 also have a pair of outwardly extending prongs 70. Depressions 86 on the underside of actuator 46 receive the prongs 70 and, together with the notches 88, aid in locating the spring 62 on the actuator 46 and in maintaining the spring 62 thereon during switch assembly.

As best shown in FIG. 4, when the actuator has been moved into a position that corresponds to one of the switch settings (defined by one of the pairs of contacts 60), the spring 62 urges the wheel 54 into the associated detent 56, and also urges the axle 58 against the corresponding pair of contacts 60 so as to define an electrical connection therebetween. Thus, the axle 58 performs two functions: it carries the wheel 54; and, it serves as a conductor for establishing an electrical connection between a pair of contacts 60 at each switch setting. See also FIG. 7.

Returning to FIG. 7, it will be seen that the actuator 46 has a pair of legs 74 that ride in the guide rails 66 of the cradle 50. It will also be seen that slots 76 are provided in opposite ends of the cradle 50 for receiving the legs 74 when the actuator has been moved to one of its extreme positions (i.e., all the way up or all the way down). As also shown in FIG. 7, the support plate 32 has a slot 78 for receiving the stalk 48 of the actuator 46. If a cover 40 of the style shown is provided, then a slot 78*a* therein also receives stalk 48. The support plate 32 may also be provided with a pair of rectangular holes 80 for affixing cover thereto by means of tabs (not shown) disposed on the underside of cover 40. Cover 40 may also be provided with a foam material 82 (FIG. 4) if desired.

Figure 6:
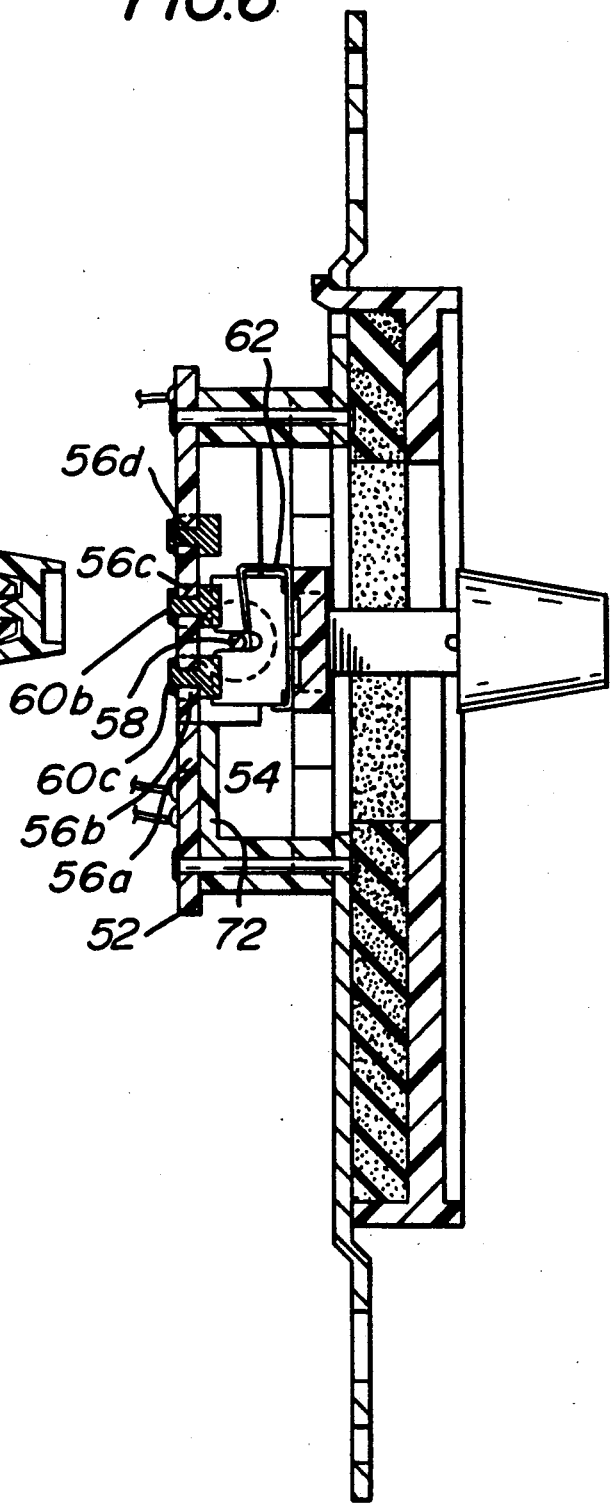
FIG. 6 is another cross section of the switch of FIG. 3 and illustrates the actuator in a position that is in-between switch settings.

Turning now to FIGS. 5 and 6, the operation of the switch of FIG. 3 will be explained. As the actuator 46 is moved from one position to another by application of an external sliding force to stalk 48, the wheel 54 rides in a path between the pairs of contacts 60. When the actuator 46 has been moved to a position that is in-between switch settings, (i.e., in-between a pair of contacts), the wheel rides on the circuit board 52 and urges the axle 58 upwardly and away from the contacts 60, as seen in FIG. 6 so as to prevent the axle 58 from dragging appreciably on the contacts 60 in-between switch settings. However, as shown in FIG. 5, when the actuator 46 has been moved to a position corresponding to one of the switch settings, the wheel 54 is urged into a detent 56 by spring 62 and the conductor 58 is also urged downwardly against the corresponding pair of contacts to establish an electrical connection therebetween.

The wheel 54 of the present invention thus serves at least three functions. First, it serves as a roller disposed between the actuator 46 and the circuit board 52 for rolling the actuator in a linear path over the circuit board 52 upon application of an external sliding force to the stalk 48. Simultaneously, the axle 58 carried by the wheel 54 establishes an electrical connection between the contacts at each setting. Second, the wheel 54, in cooperation with the spring 62 and the circuit board 52 (including detents 56 therein) automatically raises the axle 58 away from each pair of contacts 60 at one setting then lowers the axle 58 onto the contacts 60 at an immediately subsequent setting as the actuator 46 is moved between positions corresponding to those settings (see FIG. 13). Thus, as previously mentioned, the axle 58 is thereby prevented from dragging appreciably on the contacts as the actuator is moved from one position to another. Third, the wheel 54 is preferably resilient and constructed of a material such as Viton® (manufactured by E. I. DuPont DeNemours Company, Polymer Products Division, Wilmington, Del.) of nominally 75 durometer shore A, and cooperates with spring 62 to provide the desired tactile feedback to the user, and help prevent overshooting of the stopping position.

In the embodiment of the switch illustrated in FIGS. 3 and 7, the circuit board 52 is substantially parallel to the plane of the support plate 32. However, the present invention is not so limited. If desired, as illustrated in FIGS. 9 and 10, the circuit board 52 may be mounted perpendicularly to the plane of the support plate 32. The embodiment of FIGS. 9 and 10 is virtually identical to that of FIGS. 3 and 7, except for the perpendicular mounting of the circuit board, cradle and actuator. Accordingly, in FIGS. 9 and 10, like numerals have been used to represent like elements of the embodiment of FIGS. 3 and 7, except that the reference numerals have been marked with primes. As shown in FIGS. 9 and 10, a bracket 90 may be provided for affixing the circuit board 52' and cradle 50' to the support plate, wherein the wheel 54' and associated axle 58', spring 62' and actuator 46' are sandwiched between one leg of the bracket 90 and the circuit board 52'.

According to a preferred embodiment of the present invention, the switch 30 is a four position switch having three pairs of contacts 60 defining three different "on" positions. A fourth position having no contacts 60 defines an "off" position. As best shown in FIGS. 5, 6 and 7, the "off" position is defined by providing a pair of raised shoulders or shelf 72 on the cradle 50 adjacent the detent **56*a* associated with the "off" position of the switch. As best shown in FIGS. 5 and 6, the height of shelf 72 above the circuit board 52 is about the same as the height of each electrical contact 60 above the circuit board 52 so that the axle 58 rides on the shelf 72 when the actuator 46 has been moved to the off position. As shown in FIGS. 5 and 7, the detent 56*a* associated with the "off" position is somewhat larger in overall dimension than the detents 56*b*, 56*c* and 56*d* associated with all other switch positions. This allows for manufacturing flexibility in making different variations of the switch. The four switch positions may represent high, medium, low and off positions of the switch. To ensure that electrical contact is made at each "on" position, the spring 62 is preferably designed to exert a minimum force of 100 grams on each contact 60**, which is the switch industry standard force for proper switch closure for switches utilizing silver alloys as a contact materials.

As mentioned, the wheel is preferably constructed of Viton® nominally 75 durometer shore A. According to one presently preferred embodiment of the invention, the wheel 54 has a nominal diameter of 0.215 inch. Each detent 56 (except detent **56*a*) measures 0.125 inch by 0.155 inch, and detent 56*a* measures 0.125 inch by 0.175 inch. The preferred spacing between detents is 0.200 inch center to center, except between detent 56*a* and 56*b*. The preferred distance between the center of detent 56*a* and the center of detent 56*b* is 0.225 inch. As mentioned, the spring 62 is preferably designed to exert a minimum force on each contact of 100 grams at each switch setting. The cradle 50 and actuator 46 (including stalk 48**) are preferably manufactured from a non-conductive material such as glass filled polyester, such as Valox® 420 SEO (manufactured by General Electric Company, Syracuse, N.Y.).

One of the features of the present invention is that, as the actuator 46 is moved from one position to another, tactile feedback indicative of the making and breaking of electrical connections is provided to the user via the stalk 48. As a result of the increased spring tension in spring 62 when the wheel is in-between settings (e.g., FIG. 6) and the decreased spring tension in spring 62 when the wheel is in one of the detents, and as a result of the abrupt edges in the holes defining the detents 56, a snap action tactile feedback is provided to the user, via the stalk, when the wheel is both moved into and out of a detent. This is caused by the rapid urging of the wheel 54 into a detent 56 by the spring 62 once the wheel 54 has been moved to the proximity of a detent, and also by the action of the spring 62 resisting the movement of the wheel out of a detent and the following rapid overcoming of that resistance once the wheel has been urged out of the detent. Since the movement of the wheel into and out of a detent corresponds to the making and breaking, respectively, of an electrical connection, the transmission of the snap action tactile feedback to the user via the stalk tells the user that an electrical connection has been made or broken. Thus, due to the manner in which the above described elements cooperate, the sliding force required to be applied to the stalk 48 to move the actuator 46 from a first position corresponding to one setting (i.e., the position shown in FIG. 5) to a second position corresponding to another immediately preceding or succeeding setting increases from the first position to a location in-between the first and second positions (i.e., the position shown in FIG. 6), then decreases from the location in-between the first and second positions to the second position.

Figure 12:
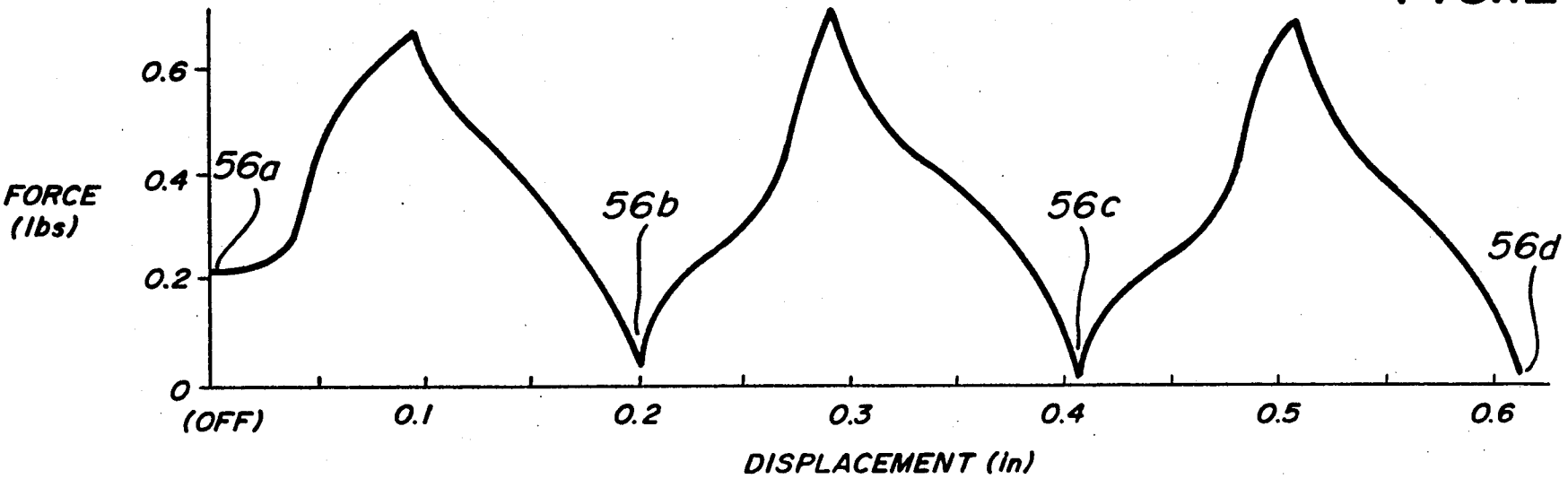
FIG. 12 is a graph illustrating a force profile of a multiple position wall mountable control switch with linear adjustment actuator according to the present invention.

FIG. 12 illustrates a so-called "force profile" for a switch constructed in accordance with the principles of the present invention. The vertical axis represents the sliding force required to be applied to the stalk 48 to move the actuator from one position to another, while the horizontal axis represents actuator displacement in inches. The location of each detent **56*a*, 56*b*, 56*c* and 56*d* has been labelled in FIG. 12. Each peak therebetween represents that portion of the circuit board 52 in-between detents. As will be seen from FIG. 12, the force required to move the actuator 46 from one "on" position to another (e.g., from that associated with detent 56*b* to that associated with detent 56*c*) increases smoothly until the wheel has reached the portion of the circuit board 52 directly in-between detents (i.e., the position depicted in FIG. 6). Thereafter, the force required decreases smoothly until the wheel has seated into the detent 56*c* (i.e., the position depicted in FIG. 5). The operation of the switch is identical for moving the actuator between all other "on" settings of the switch. As shown, a greater force is required to move the switch from the "off" position (that associated with detent 56*a*) due to the increased frictional forces generated by sliding the axle 58 along shelf 72 as described above. The extreme upper and lower peaks in FIG. 12** graphically illustrate the snap action provided by the switch of the present invention.

Figure 13:
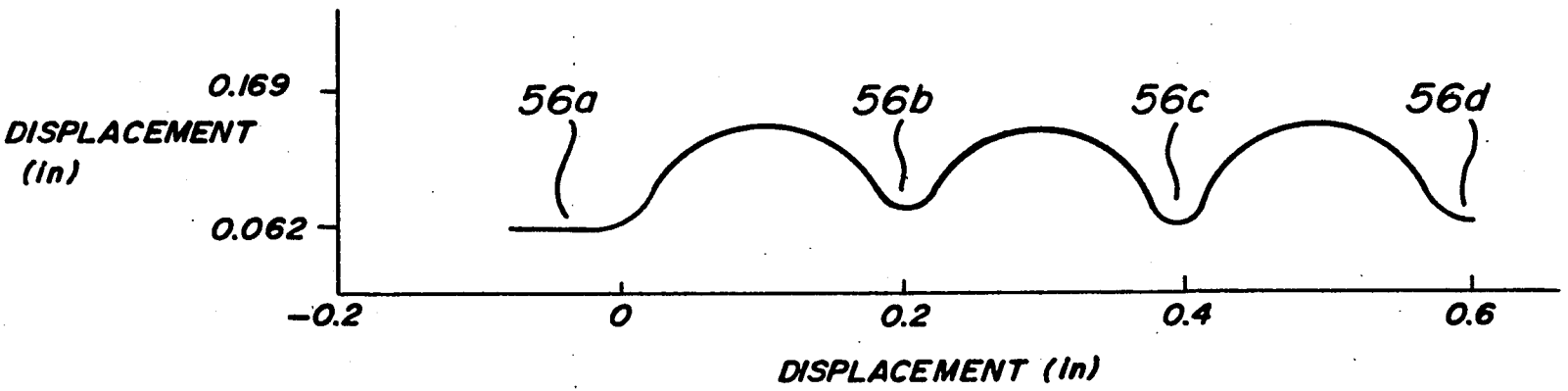
FIG. 13 is a graph illustrating the path travelled by the axle of the wheel of the switch of FIG. 7.

FIG. 13 illustrates the path of travel of the wheel 54 and demonstrates how the wheel is displaced up and down as the actuator is moved from one position to another by the cooperation of the spring 62, detents 56 and bearing surface 52. Preferred displacement (inches) of the wheel as it travels from one detent to another is shown.

As illustrated in FIG. 11, a multiple position switch 30' according to the present invention may be provided with a rocker switch 92 for adding additional control functions thereto. For example, the linear slide switch portion of switch 30' may be used to control the speed of a ceiling fan, and the rocker switch 92 may be used to control an associated light fixture. In such event, three conductors 42' may be provided for fully controlling the load, i.e., the fan and the light fixture.

Details of the control circuit 38 do not form a part of the present invention, however, a circuit such as described in the above referenced copending U.S. application Ser. No. '604 may be employed in the practice of the present invention.

There has been shown and described a novel multiple position, wall-mountable control switch with linear adjustment actuator. Many changes, modifications, variations and other uses and applications of the subject invention will, however, become apparent to those skilled in the art after considering this specification and accompanying drawings which disclose only preferred embodiments thereof. All such changes, modifications, variations and other uses and applications which do not depart from the spirit and scope of the invention are deemed to be covered by the invention which is limited only by the claims which follow.

We claim:

1. A switch comprising:

(a) a plurality of electrical contacts defining a plurality of different switch settings;

(b) an actuator movable in a linear path between positions corresponding to each switch setting;

(c) roller means disposed between the actuator and a stationary bearing surface for rolling the actuator in the linear path over the stationary bearing surface upon application of an external sliding force to the actuator, the stationary bearing surface being distinct from, and the roller means being substantially electrically isolated from, the electrical contacts, the roller means carrying a conductor for establishing an electrical connection between the contacts at each setting, the conductor being raised away from the electrical contacts between switch settings.

2. Switch according to claim 1 wherein the stationary bearing surface is a surface of a circuit board having a control circuit and the contacts disposed thereon.

3. Switch according to claim 1 further comprising a support plate defining a yoke having inner and outer surfaces for mounting to a wall box embedded in a wall, the contacts, actuator roller means and bearing surface all being disposed adjacent the inner surface of the yoke, the actuator comprising a stalk extending through the yoke and accessible from the outer surface for applying the external sliding force to the actuator.

4. Switch according to claim 3 wherein the actuator is slidably captured between the inner surface of the yoke and the bearing surface.

5. Switch according to claim 1, 2, 3 or 4 further comprising a cradle mounted to the bearing surface and having a pair of guide rails supporting the actuator and defining a linear path for movement of the actuator.

6. Switch according to claim 3 or 4 further comprising a cradle mounted between the inner surface of the yoke and the bearing surface and having a pair of guide rails supporting the actuator and defining a linear path for movement of the actuator.

7. Switch according to claim 1 further comprising a spring means associated with the roller means for urging both the roller means against the bearing surface and the conductor against the contacts at each setting, the roller means and spring means cooperating with the bearing surface to automatically raise the conductor away from the contacts at one setting then lower the conductor onto the contacts at an immediately subsequent setting as the actuator is moved between the corresponding positions, the conductor thereby being prevented from dragging appreciably on the contacts.

8. Switch according to claim 1 or 7 wherein the roller means is a resilient wheel and the conductor is an axle extending through the wheel, each setting being defined by a pair of contacts with the wheel being arranged to travel therebetween and the axle being arranged to establish the electrical connection between the contacts at each setting.

9. Switch according to claim 8 further comprising a support plate defining a yoke having inner and outer surfaces for mounting to a wall box embedded in a wall and wherein the actuator is slidably captured between the inner surface of the yoke and the bearing surface.

10. Switch according to claim 7 wherein the roller means is a resilient wheel and the conductor is an axle extending through the wheel and wherein the actuator has a pair of spaced outwardly extending members with a notch therein, the wheel being disposed between the members and the axle being disposed in the notch.

11. Switch according to claim 10 wherein the spring means comprises a substantially U-shaped resilient member adapted to be received by the pair of members and having one leg urging against a substantially flat surface of the actuator and another leg urging against the axle.

12. Switch according to claim 2 wherein the circuit board has a detent adjacent the contacts of each switch setting, the roller means being urged against the circuit board by a spring force, the roller means being rolled into and urged against one of the detents by the spring force when the actuator has been moved to a position corresponding to one of the switch settings, the electrical connection being established by the conductor only when the roller has been rolled into and urged against one of the detents, the rolling and urging of the roller means into a detent providing a positive tactile feedback to a user moving the actuator that an electrical connection has been established.

13. Switch according to claim 12 wherein application of the external sliding force by an amount sufficient to overcome the spring and resulting frictional forces required to be applied to the actuator by the user to roll the roller means out of a detent once an electrical connection has been established as a result of the roller means having been rolled and urged into a detent, the overcoming of the spring and resulting frictional forces and the rolling of the roller means out of a detent being transmitted through the actuator and providing a positive tactile feedback to the user that the electrical connection has been broken.

14. Switch according to claim 1 wherein a spring means urges the roller means against the bearing surface and the bearing surface has a detent associated with each setting, and wherein the external sliding force required to be applied to move the actuator from a first position corresponding to one setting to a second position corresponding to another immediately preceding or succeeding setting increases from the first position to a location in-between the first and second positions then decreases from the location in-between the first and second positions to the second position, and wherein, when the actuator has been moved to within proximity of a position corresponding to one of the settings, the spring means rapidly urges the roller means into the associated detent to provide a first tactile feedback to the user, and when the actuator is moved out of a position corresponding to a setting, the action of the roller means rolling out of the associated detent is resisted by but rapidly overcomes the spring means to provide a second tactile feedback to the user.

15. Switch according to claim 3 further comprising a cover of smaller overall dimensions than the yoke mounted to the outer surface of the yoke, the stalk extending through the cover and having a knob disposed thereon, the cover being adapted to be received by an opening of a decorator style wall plate.

16. Switch according to claim 3 wherein the wall box has a width of about 1 31/32" and a length of about 3 9/32".

17. Switch according to claim 3 wherein the yoke and bearing surface are disposed in substantially parallel planes and the stalk is substantially perpendicular to the planes of the yoke and bearing surface.

18. Switch according to claim 3 wherein the yoke and bearing surface are disposed in substantially perpendicular planes and the stalk is substantially parallel to the plane of the bearing surface.

19. Switch according to claim 2 wherein the control circuit is a fan speed control circuit and each setting represents a desired speed for the fan.

20. Switch according to claim 1 or 19 wherein there are four settings.

21. Switch according to claim 7 further comprising an off setting corresponding to an off condition of the switch and a cradle having a shoulder portion mounted on the bearing surface at a location adjacent the off setting, the shoulder portion cooperating with the conductor to urge the conductor against the spring means at the off setting such that the external sliding force required to move the actuator out of the position corresponding to the off setting is greater than the external sliding force required to move the actuator out of positions corresponding to other settings.

22. A switch comprising:

a) a plurality of electrical contacts defining a plurality of different switch settings;

b) an actuator movable in a linear path between positions corresponding to each switch setting and having associated therewith a conductor movable with the actuator for establishing an electrical connection between the contacts at each setting; and, c) means cooperating with the conductor for automatically raising the conductor away from the contacts at one setting then lowering the conductor onto the contacts at a immediately subsequent setting as the actuator is moved between the corresponding positions.

23. Switch according to claim 22 wherein the means for raising and lowering the conductor comprises spring loaded roller means coupled to the ,.actuator for rolling on a stationary bearing surface as the actuator moved is between positions, the bearing surface having a detent associated with each setting, the detents being in a path of travel of the roller means.

24. Switch according to claim 23 wherein the bearing surface is a surface of a circuit board having a control circuit and the contacts disposed thereon.

25. Switch according to claim 23 wherein the conductor is integral with and travels with the roller means.

26. Switch according to claim 25 wherein the roller means is a resilient wheel and the conductor is an axle extending through the wheel, each setting being defined by a pair of contacts with the wheel being arranged to travel therebetween and the axle being arranged to establish the electrical connection between the contacts at each setting.

27. Switch according to claim 26 wherein the actuator has a pair of spaced, outwardly extending members with a notch therein, the wheel being disposed between the members and the axle being disposed in the notch.

28. Switch according to claim 27 wherein the spring loading is provided by a substantially U-shaped resilient member adapted to be received by the pair of members and having one leg urging against a substantially flat surface of the actuator and another leg urging against the axle.

29. Switch according to claim 23 further comprising a support plate defining a yoke having inner and outer surfaces for mounting to a wall box embedded in a wall, the contacts, actuator, roller means and bearing surface all being disposed adjacent the inner surface of the yoke, the actuator comprising a stalk extending through the yoke and accessible from the outer surface for applying a sliding force to the actuator.

30. Switch according to claim 29 wherein the actuator is slidably captured between the inner surface of the yoke and the bearing surface.

31. Switch according to claim 29 or 30 further comprising a cradle mounted to the bearing surface and having a pair of guide rails supporting the actuator and defining a linear path for movement of the actuator.

32. Switch according to claim 29 or 30 further comprising a cradle mounted between the inner surface of the yoke and the bearing surface and having a pair of guide rails supporting the actuator and defining a linear path for movement of the actuator.

33. Switch according to claim 23 wherein the roller means is urged against the bearing surface by the spring loading, the roller means being rolled into and urged against one of the detents by the spring loading when the actuator has been moved to a position corresponding to one of the switch settings, the electrical connection being established by the conductor only when the roller has been rolled into and urged against one of the detents, the rolling and urging of the roller means into a detent providing a positive tactile feedback to a user moving the actuator that an electrical connection has been established.

34. Switch according to claim 33 wherein a sliding force sufficient to overcome a force provided by the spring loading is required to be applied to the actuator by the user to roll the roller means out of a detent once an electrical connection has been established as a result of the roller means having been rolled and urged into a detent, the overcoming of the force provided by the spring loading and the rolling of the roller means out of a detent being transmitted through the actuator and providing a positive tactile feedback to the user that the electrical connection has been broken.

35. Switch according to claim 24 wherein the spring loading urges the roller means against the circuit board and application of an external sliding force is required to move the actuator from a first position corresponding to one setting to a second position corresponding to another immediately preceding or succeeding setting, and wherein the external force required increases from the first position to a location in-between the first and second positions then decreases from the location in-between the first and second positions to the second position, and further wherein, when the actuator has been moved to within proximity of a position corresponding to one of the settings, the action of spring loading rapidly urges the roller means into the associated detent to provide a first tactile feedback to the user, and when the actuator is moved out of a position corresponding to a setting, the action of the roller means rolling out of the associated detent resists but rapidly overcomes the spring loading to provide a second tactile feedback to the user.

36. Switch according to claim 29 further comprising a cover of smaller overall dimensions than the yoke mounted to the outer surface of the yoke, the stalk extending through the cover and having a knob disposed thereon, the cover being adapted to be received by an opening of a decorator style wall plate.

37. Switch according to claim 29 wherein the wall box has a width of about 1 31/32" and a length of about 3 9/32".

38. Switch according to claim 29 wherein the yoke and bearing surface are disposed in substantially parallel planes and the stalk is substantially perpendicular to the planes of the yoke and bearing surface.

39. Switch according to claim 29 wherein the yoke and bearing surface are disposed in substantially perpendicular planes and the stalk is substantially parallel to the plane of the bearing surface.

40. Switch according to claim 24 wherein the control circuit is a fan speed control circuit and each setting represents a desired speed for the fan.

41. Switch according to claim 24 o 40 wherein there are four settings.

42. Switch according to claim 28 wherein an external sliding force is required to be applied to the actuator to move the actuator from one position to another, further comprising an off setting corresponding to an off condition of the switch and a cradle having a shoulder portion mounted on the bearing surface at a location adjacent the off setting, the shoulder portion cooperating with the axle to urge the axle against the spring means at the off setting such that the external sliding force required to move the actuator out of the position corresponding to the off setting is greater than the external sliding force required to move the actuator out of positions corresponding to other settings.

43. A switch comprising:

a) a printed circuit board having disposed thereon a plurality of electrical contacts defining a plurality of different switch settings, the printed circuit board having a detent adjacent the contacts of each switch setting;

b) an actuator movable in a linear path between positions corresponding to each switch setting;

c) spring loaded roller means coupled to the actuator for rolling on the printed circuit board in response to application of an external sliding force to the actuator, the roller means being urged against the printed circuit board by a spring force provided by the spring loaded roller means, the roller means being rolled into and urged against one of the detents by the spring force when the actuator has been moved to a position corresponding to one of the switch settings, the roller means including an integral conductor for establishing an electrical connection between contacts at each setting when the roller has been rolled into and urged against a corresponding detent, the rolling and urging of the roller means into a detent providing a positive tactile feedback to a user moving the actuator that an electrical connection has been established.

44. Switch according to claim 43 wherein application of the external sliding force by an amount sufficient to overcome the spring force is required to be applied to the actuator by the user to roll the roller means out of a detent once an electrical connection has been established as a result of the roller means having been rolled and urged into a detent, the overcoming of the spring force and the rolling of the roller means out of a detent being transmitted through the actuator and providing a positive tactile feedback to the use that the electrical connection has been broken.

45. Switch according to claim 43 wherein the external sliding force required to be applied to move the actuator from a first position corresponding to one setting to a second position corresponding to another immediately preceding or succeeding setting increases from the first position to a location in-between the first and second positions then decreases from the location in-between the first and second positions to the second position, and wherein, when the actuator has been moved to within proximity of a position corresponding to one of the settings, the action of spring loading rapidly urges the roller means into the associated detent to provide a first tactile feedback to the user, and when the actuator is moved out of a position corresponding to a setting, the action of the roller means rolling out of the associated detent resists but rapidly overcomes the spring loading to provide a second tactile feedback to the user.

46. Switch according to claim 43 further comprising a support plate defining a yoke having inner and outer surfaces for mounting to a wall box embedded in a wall, the circuit board, actuator and roller means all being disposed adjacent the inner surface of the yoke, the actuator comprising a stalk extending through the yoke and accessible from the outer surface for applying the external sliding force to the actuator.

47. Switch according to claim 46 wherein the actuator is slidably captured between the inner surface of the yoke and the circuit board.

48. Switch according to claim 43, 44, 45 , 46 or 47 further comprising a cradle mounted to the circuit board and having a pair of guide rails supporting the actuator and defining a linear path for movement of the actuator.

49. Switch according to claim 46 or 47 further comprising a cradle mounted between the inner surface of the yoke and the circuit board and having a pair of guide rails supporting the actuator and defining a linear path for movement of the actuator.

50. Switch according to claim 43 wherein the roller means cooperates with the printed circuit board and the detents to automatically raise the conductor away from the contacts at one setting then lower the conductor onto the contacts at an immediately subsequent setting as the actuator is moved between the corresponding positions, the conductor thereby being prevented from dragging appreciably on the contacts.

51. Switch according to claim 43 or 50 wherein the roller means is a resilient wheel and the conductor is an axle extending through the wheel, each setting being defined by a pair of contacts with the wheel being arranged to travel therebetween and the axle being arranged to establish the electrical connection between the contacts at each setting.

52. Switch according to claim 51 further comprising a support plate defining a yoke having inner and outer surfaces for mounting to a wall box embedded in a wall and wherein the actuator is slidably captured between the inner surface of the yoke and the circuit board.

53. Switch according to claim 51 wherein the actuator has a pair of spaced outwardly extending members with a notch therein, the wheel being disposed between the members and the axle being disposed in the notch.

54. Switch according to claim 53 wherein the spring loading is provided by a substantially U-shaped resilient member adapted to be received by the pair of members and having one leg urging against a substantially flat surface of the actuator and another leg urging against the axle.

55. Switch according to claim 46 further comprising a cover of smaller overall dimensions than the yoke mounted to the outer surface of the yoke, the stalk extending through the cover and having a knob disposed thereon, the cover being adapted to be received by an opening of a decorator style wall plate.

56. Switch according to claim 46 wherein the wall box has a width of about 1 31/32" and a length of about 3 9/32".

57. Switch according to claim 46 wherein the yoke and circuit board are disposed in substantially parallel planes and the stalk is substantially perpendicular to the planes of the yoke and bearing surface.

58. Switch according to claim 46 wherein the yoke and bearing surface are disposed in substantially perpendicular planes and the stalk is substantially parallel to the plane of the bearing surface.

59. Switch according to claim 43 wherein the circuit board further has a fan speed control circuit disposed thereon and each setting represents a desired speed for the fan.

60. Switch according to claim 43 or 59 wherein there are four settings.

61. Switch according to claim 51 further comprising an off setting corresponding to an off condition of the switch and a cradle having a shoulder portion mounted on the circuit board at a location adjacent the off setting, the shoulder portion cooperating with the axle to urge the axle against the spring means at the off setting such that the external sliding force required to move the actuator out of the position corresponding to the off setting is greater than the external sliding force required to move the actuator out of positions corresponding to other settings.

62. A multi-position slide switch comprising:

a) a support plate defining a yoke having inner and outer surfaces and adapted to be mounted to an electrical wall box embedded in a wall;

b) a linearly movable actuator disposed adjacent the inner surface of the yoke and having a stalk extending through the yoke accessible from the outer surface for applying a sliding force to the actuator, the actuator having first means for receiving an electrically conductive axle carrying a resilient wheel and second means for applying a spring force to the axle, the axle and wheel moving together with the actuator;

c) a cradle disposed adjacent the inner surface of the yoke and having a pair of guide rails supporting the actuator and defining a linear path for movement of the actuator;

d) a circuit board mounted to the cradle and having a control circuit disposed thereon including plural pairs of opposing electrical contacts disposed on a portion of the board circumscribed by the cradle and further having a detent associated with each pair of contacts, the detents being substantially aligned in a path of travel of the wheel, each pair of contacts and associated detent defining a different switch setting, the spring force urging the wheel against the board and the wheel travelling on the board in-between switch settings and, at a switch setting, the spring force urging the wheel into one of the detents and urging the axle into electrical contact with and establishing an electrical connection between the pairs of contacts at the switch setting, the spring force, wheel and detents cooperating to automatically raise the axle away from the contacts at one setting then lower the axle onto the contacts at a subsequent setting as the actuator is moved so as to prevent the axle from dragging appreciably on the contacts.

63. Switch according to claim 62 wherein the cradle is mounted to the inner surface of the yoke and the yoke, cradle and circuit board are disposed in substantially parallel planes and the stalk is substantially perpendicular to the planes of the yoke, cradle and circuit board.

64. Switch according to claim 62 wherein circuit board and yoke are disposed in substantially perpendicular planes and the stalk is substantially perpendicular the plane of the yoke and substantially parallel to the plane of circuit board.

65. Switch according to claim 62 wherein the first means comprises a pair of spaced outwardly extending members with a notch therein, the wheel being disposed between the members and the axle being disposed in the notch.

66. Switch according to claim 65 wherein the second means comprises a substantially U-shaped resilient member adapted to be received by the pair of members and having one leg urging against a substantially flat surface of the actuator and another leg urging against the axle.

67. Switch according to claim 62 wherein the second means comprises a spring means and the sliding force required to be applied to move the actuator from a first position corresponding to one setting to a second position corresponding to another immediately preceding or succeeding setting increases from the first position to a location in-between the first and second positions then decreases from the location in-between the first and second positions to the second positions, and wherein, when the actuator has been moved to within proximity of a position corresponding to one of the settings, the action of the spring means rapidly urges the wheel into the associated detent to provide a first tactile feedback via the stalk to the user, and when the actuator is moved out of a position corresponding to a setting, the action of the wheel rolling out of the associated detent resists but rapidly overcomes the spring means to provide a second tactile feedback via the stalk to the user.

68. Switch according to claim 62 further comprising a cover of smaller overall dimensions than the yoke mounted to the outer surface of the yoke, the stalk extending through the cover and having a knob disposed thereon, the cover being adapted to be received by an opening of a decorator style wall plate.

69. Switch according to claim 62 wherein the wall box has a width of about 1 31/32" and a length of about 3 9/32".

70. Switch according to claim 62 wherein the control circuit is a fan speed control circuit and each setting represents a desired speed for the fan.

71. Switch according to claim 62 or 70 wherein there are four settings.

72. Switch according to claim 62 further comprising an off setting corresponding to an off condition of the switch, the cradle having a shoulder portion mounted on the circuit board at a location adjacent the off setting, the shoulder portion cooperating with the axle to urge the axle against the second means at the off setting such that the sliding force required to move the actuator out of the position corresponding to the off setting is greater than the sliding force required to move the actuator out of positions corresponding to other settings.

73. A multi-position slide switch for controlling the speed of a fan comprising:

a) a support plate defining a yoke having inner and outer surfaces and adapted to be mounted to an electrical wall box having a width of about 1 31/32" and a length of about 3 9/32" embedded in a wall;

b) a linearly movable actuator disposed adjacent the inner surface of the yoke and having a stalk extending through the yoke accessible from the outer surface for applying a sliding force to the actuator, the actuator having a pair of outwardly extending members and a notch for receiving an electrically conductive axle carrying a resilient wheel, there being a substantially U-shaped spring disposed about the pair of members having one pair of legs urging against the actuator and another pair of legs urging against the axle for applying a spring force to the axle, the axle, wheel and U-shaped spring moving together with the actuator;

c) a cradle disposed adjacent the inner surface of the yoke and having a pair of guide rails supporting the actuator and defining a linear path for movement of the actuator;

d) a circuit board mounted to the cradle and having a control circuit disposed thereon including plural pairs of opposing electrical contacts disposed on a portion of the board circumscribed by the cradle, each pair of contacts representing a desired speed of the fan, and further having a detent associated with each pair of contacts, the detents being substantially aligned in a path of travel of the wheel, each pair of contacts and associated detent defining a different switch setting, the U-shaped spring urging the wheel against the board and the wheel travelling on the board in-between switch settings and, at a switch setting, the U-shaped spring urging the wheel into one of the detents and urging the axle into electrical contact with and establishing an electrical connection between the pairs of contacts at the switch setting, the U-shaped spring, wheel and detents cooperating to automatically raise the axle away from the contacts at one setting then lower the axle onto the contacts at a subsequent setting as the actuator is moved so as to prevent the axle from dragging appreciably on the contacts;

the sliding force required to be applied to the stalk to move the actuator from a first position corresponding to one setting to a second position corresponding to another immediately preceding or succeeding setting increasing from the first position to a location in-between the first and second positions then decreasing from the location in-between the first and second positions to the second position, and wherein, when the actuator has been moved to within proximity of a position corresponding to one of the settings, the action of spring loading rapidly urges the wheel into the associated detent to provide a first snap action tactile feedback via the stalk to the user, and when the actuator is moved out of a position corresponding to a setting, the action of the wheel rolling out of the associated detent resists but rapidly overcomes the spring loading to provide a second snap action tactile feedback via the stalk to the user.

74. Switch according to claim 73 wherein the cradle is mounted to the inner surface of the yoke and the yoke, cradle and circuit board are disposed in substantially parallel planes and the stalk is substantially perpendicular to the planes of the yoke, cradle and circuit board.

75. Switch according to claim 73 wherein circuit board and yoke are disposed in substantially perpendicular planes and the stalk is substantially perpendicular the plane of the yoke and substantially parallel to the plane of circuit board.

76. Switch according to claim 73 further comprising an off setting corresponding to an off condition of the switch, the cradle having a shoulder portion mounted on the circuit board at a location adjacent the off setting, the shoulder portion cooperating with the axle to urge the axle against the U-shaped spring at the off setting such that the sliding force required to move the actuator out of the position corresponding to the off setting is greater than the sliding force required to move the actuator out of positions corresponding to other settings.

* * * * *